US007044416B2

(12) United States Patent
Salvador

(10) Patent No.: US 7,044,416 B2
(45) Date of Patent: May 16, 2006

(54) TENSIONING BOARD FOR SLIT METAL REWINDING

(76) Inventor: Gonzalo Salvador, 516 Industrial Dr., Woodstock, GA (US) 30189

( * ) Notice: Subject to any disclaimer, the term of this patent is extended or adjusted under 35 U.S.C. 154(b) by 107 days.

(21) Appl. No.: 10/900,510

(22) Filed: Jul. 28, 2004

(65) Prior Publication Data

US 2006/0022080 A1 Feb. 2, 2006

(51) Int. Cl.
*B65H 23/18* (2006.01)
*B65H 77/00* (2006.01)
*B65H 18/08* (2006.01)

(52) U.S. Cl. ..... 242/419.4; 242/149; 242/530.1; 226/195

(58) Field of Classification Search ..... 242/419.4, 242/149, 530, 530.1; 188/65.1, 65.2, 250 D, 188/250 G; 226/195, 196.1
See application file for complete search history.

(56) References Cited

U.S. PATENT DOCUMENTS 2,686,639 A * 8/1954 Campbell ..... 242/419.4
2,849,193 A * 8/1958 Pauls et al. ..... 242/524.1
3,229,881 A * 1/1966 Eckhardt ..... 226/195
3,380,686 A * 4/1968 Gaudin ..... 242/419.3
3,672,595 A * 6/1972 Jablin et al. ..... 242/419.4
5,706,917 A * 1/1998 Matsuzaki ..... 188/73.38
5,722,577 A * 3/1998 Simpson ..... 226/195
6,105,735 A * 8/2000 Lin et al. ..... 188/73.1
6,244,396 B1 * 6/2001 Lumpkin ..... 188/250 B
6,964,392 B1 * 11/2005 Matsunaga ..... 242/419.4

FOREIGN PATENT DOCUMENTS

JP 05208214 A * 8/1993

* cited by examiner

*Primary Examiner*—Kathy Matecki
*Assistant Examiner*—William E. Dondero
(74) *Attorney, Agent, or Firm*—John L. James

(57) ABSTRACT

An apparatus for tensioning strips of metal as the metal strips are rewound comprises a board having a top surface defining a groove and a tray having opposed side portions and opposed end portions and disposed in the groove. Each of the side portions of the tray has an upturned flange. A hook pad having a plurality of upwardly extending hooks is disposed in the tray between the flanges. The hook pad and tray are removably fastened the to the board.

9 Claims, 3 Drawing Sheets

TENSIONING BOARD FOR SLIT METAL REWINDING

TECHNICAL FIELD OF THE INVENTION

This invention relates generally to slitting a coil of metal into strips, and, more particularly, to tensioning board for holding and tensioning slit metal strips as the strips are rewound.

BACKGROUND OF THE INVENTION

Coil steel and other metals come from the manufacturing plant in rolls or coils. The metal typically has a crown; that is, the metal is thicker in the center than at the edges. The coil is unwound, slit into ribbons and rewound. Because the center ribbons are thicker than the edge ribbons, the edge ribbons are typically longer and have a tendency to be loose when rewound. A loose coil is undesirable because looseness or uneven tension interferes with the metal processing which requires even tension to produce uniform results without undue wear on the processing equipment.

A component of a slitting line for a metal coil is a tension stand which is typically two wooden boards attached to a metal frame and covered with felt or similar material that is wider than the pre-slit coil. Pneumatic or hydraulic cylinders open and close the wooden boards to pinch the metal after slitting. As the metal is rewound, the longer ribbons accumulate slack in a pit. A problem with this process is attaching the felt to the boards.

In the past, the felt attached by nailing or stapling which worked reasonably well except that different types of metal (stainless steel, aluminum, cold rolled steel, hot rolled steel, etc.), textures (polished, embossed, motorlam, etc.) and finishes (painted, galvanized, etc.) caused a need for the felt pad to be replaced frequently, sometimes after each coil. The felt would either wear away or become contaminated with dirt and debris causing metal damage. Removing the nails or staples was time consuming and the wood needed to be replaced frequently due to the constant damage caused by the nails and staples.

One solution to the problem of replacing worn or damaged boards and pads was to use a board with hook and loop fasteners to secure the felt. The hook portion of a hook and loop fastener was glued to the board and the felt pressed onto it. While the felt could be easily removed for replacement, the adhesion was not very good. In addition, the friction of the metal passing through the felt pads created heat sufficient to soften the glue causing a loss of adhesion and failure.

A plastic saddle was developed to solve the wood to fastener adhesion problem. A special heat resistant adhesive was used to bond the hook fastener to the saddle. The saddle would fit over the top of the wooden board and had holes for screws to secure it to the board. Although the saddle improved metal slitting operations, there was still a problem because the hook fastener did not grip the felt sufficiently.

Also, the metal coils sometimes had defects, such as a line stop that could snag the felt, or a weld across the width of the metal where two coils are joined. For galvanized steel, a line stop forms during manufacturing where the line stops but the coating of zinc continues and forms a build-up or lump. When a line stop or weld travel through the tension stand, it will usually snag on the felt pad ripping the pad off the hook fastener, and sometimes destroying the saddle. Accordingly, it will be appreciated that it would be highly desirable to have a tension board that securely holds the felt pad without nails, staples or glue, and which facilitates rapid changing of the pad.

SUMMARY OF THE INVENTION

The present invention is directed to overcoming one or more of the problems set forth above. Briefly summarized, according to one aspect of the present invention, an apparatus for tensioning strips of metal as the metal strips are rewound comprises a board having a top surface defining a groove and a tray having opposed side portions and opposed end portions and disposed in the groove. Each of the side portions of the tray has an upturned flange. A hook pad having a plurality of upwardly extending hooks is disposed in the tray between the flanges. The hook pad and tray are removably fastened the to the board.

The hooks of the hook pad attach a felt pad to the board. A pair of boards are used for tensioning, one on top of the strips and one below the strips. Two boards cooperate to grip and tension the metal strips as they are rewound. Glue is not used, so there is no glue to soften and loosen the felt pad. Hook and loop fasteners are not used, so there is no adhesion problem. The tips of the metal hooks are flush with the top surface of the board and grip the felt pad when placed thereon.

According to another aspect of the invention, a tensioning board has a top surface defining a groove and a bottom surface. A cover having a recessed portion is positioned on the top surface with the recessed portion disposed in the groove. The cover is removably attached to the board. A tray having opposed side portions and opposed end portions is disposed in the recessed portion. Each of the side portions has an upturned flange. A hook pad is disposed in the tray between the flanges and has a plurality of upwardly extending hooks.

The cover forms a channel member that can be inserted and removed from the board with the tray and hook pad attached which is much less cumbersome than removing the entire board. The channel member fits in the grooves in the sides of the board and no nails or adhesive are used thereby increasing the useful life of the board.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Figure 1:
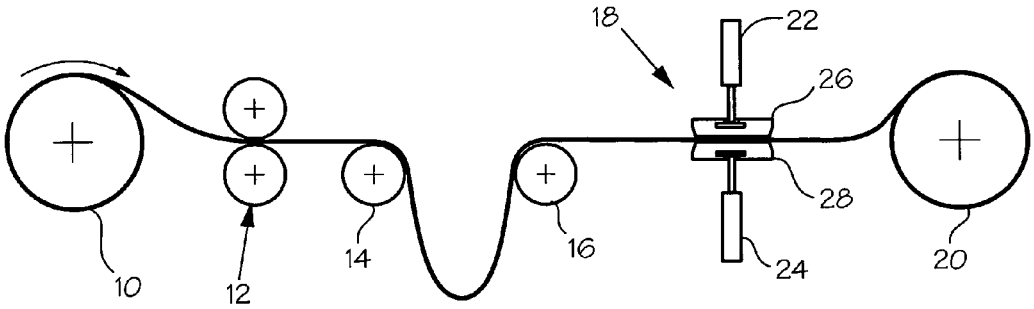
FIG. 1 is a diagram of a metal slitting and rewinding operation using a tensioning board device according to the present invention.
Figure 2:
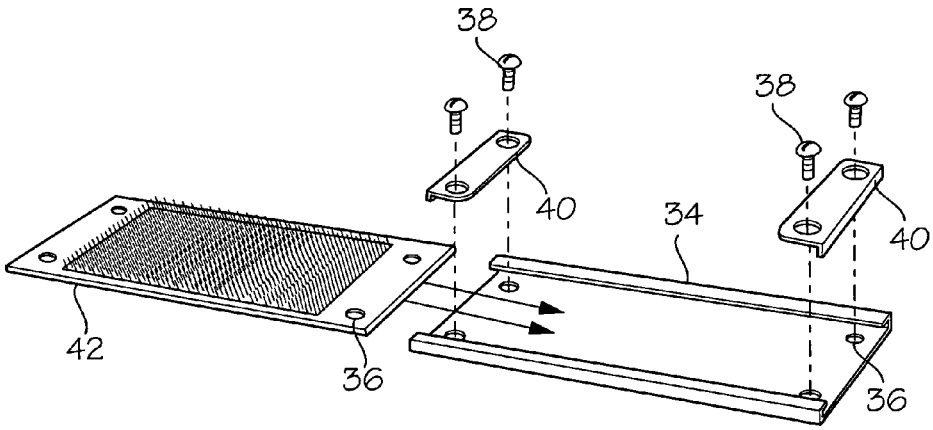
FIG. 2 is a perspective view of a preferred embodiment of the tensioning board device of FIG. 1.
Figure 3:
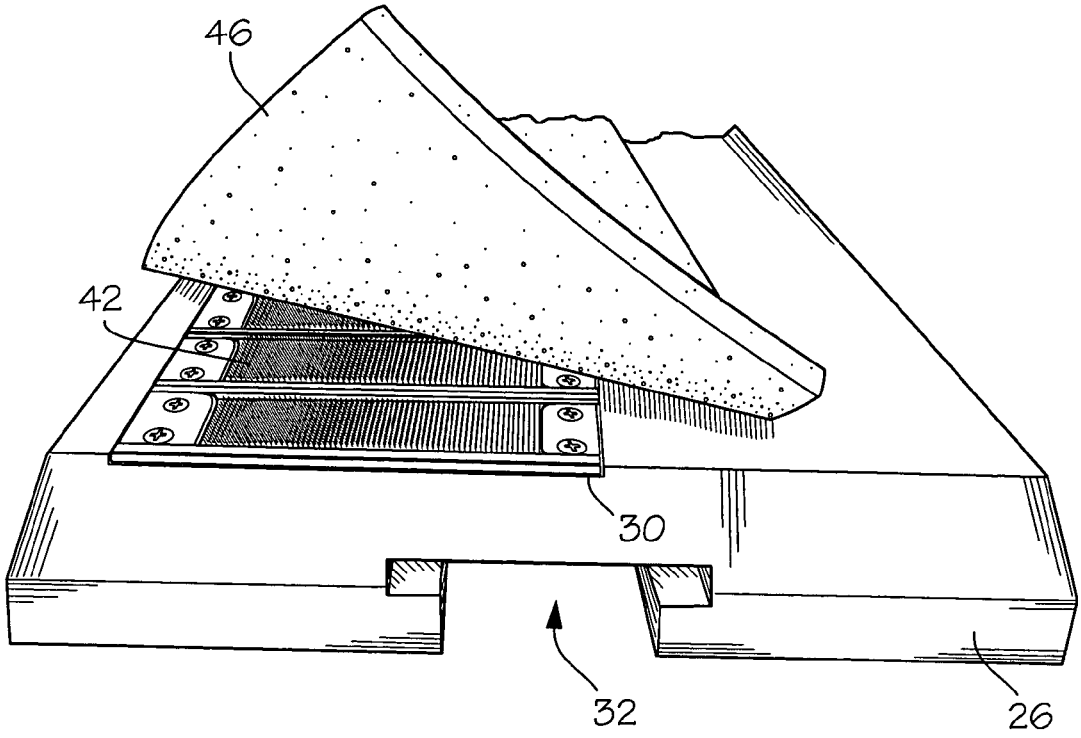
FIG. 3 is a view of the felt gripping member of the tensioning board device of FIG. 2.
Figure 4:
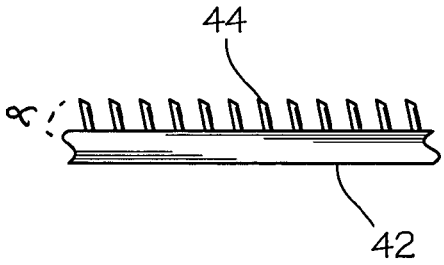
FIG. 4 is a diagrammatic side view of the felt gripping member FIG. 3.

Referring to FIGS. 1–4, a wound roll 10 of metal is unwound and fed to a slitter 12 where it is slit into a number of narrower widths. Because roll 10 typically comes from the manufacturing mill with a slight crown, either intentionally or due to equipment wear, the center width of roll 10 is thicker than the edge widths. When cut into strips, the edge strips may be longer than the center strips due to the of the difference in metal thickness. The slit metal strips pass over rollers 14 and 16 which are spaced apart. A pit exists below rollers 14, 16 where slit metal can accumulate during slitting. A tensioning mechanism 18 grabs the metal slits and a mandrel 20 rewinds the metal strips into individual coils. Mandrel 20 rewinds all coils at a single speed, but the thinner and therefore longer strips, loop down into the pit during the process.

The tensioning mechanism 18 includes upper and lower jacks 22, 24 attached to upper and lower tensioning boards, 26, 28, respectively. Upper and lower boards 26 and 28 are identical and board 26 is described in detail herein. Lower board 28 has a top surface defining a top groove 30 therein and has a bottom surface defining a bottom, locking groove 32 therein. Bottom groove 32 slides onto an attaching member connected to lower jack 22 to attach board 26 to jack 22. Bottom groove 32 is preferably T-shaped to receive a T-shaped attaching member. By this construction boards can be installed and removed easily, yet limit movement in the direction of metal travel. One or both jacks can operate to move its associated tensioning board bringing the tensioning boards together to grip and tension the metal.

A number of trays 34 are disposed side by side in the top groove 30 of the board 26. Each tray 34 has opposed side portions and opposed end portions with each side portions having an upturned flange or J-channel that is perpendicular to groove 30.

Each end portion preferably has a plurality of screw holes 36 to receive screws 38. Screw holes 36 preferably align with similar screw holes in cover 32. Each end of tray 34 is secured to board 26 with an end clip 40 that has screw holes aligned with screw holes 36. Screws 38 secure end clip 40 and tray 26 to board 26. A metal screw may be used with threaded socket embedded in the board so that a tray can be removed and reinstalled easily and repeatedly.

A hook pad 42 is disposed in the tray between the flanges with the flanges limiting upward and lateral movement of the hook pad in the tray. Hook pad 42 has a plurality of upwardly extending staples or hooks 44. Hooks 44 are oriented at an angle $\alpha$ of between about 45 degrees and 75 degrees with an angle $\alpha$ of about 70 degrees being preferred. The exposed tips of hooks 44 are parallel to the base of hook pad 42 (horizontal when installed) and thus form a chisel tip with the sharp point oriented opposite the direction of travel of the metal strips. The exposed tips of the hooks may be flush with the top surface of the board or, preferably, recessed.

A felt or similar pad 46 of material is used on each board to actually grip the slit metal without marring the finish of the metal. The hooks grab and hold the felt pad to the board. As the metal passes through the upper and lower felt pads, the hooks hold faster because the direction of travel of the slit metal is such that the felt is pushed into the chisel points of the hooks. The felt is easily released when desired by pulling it from the board in the direction opposite to the direction of travel of the slit metal. It has been discovered that after one side of the felt has been used, it can be turned over and the other side used as well.

Figure 5:
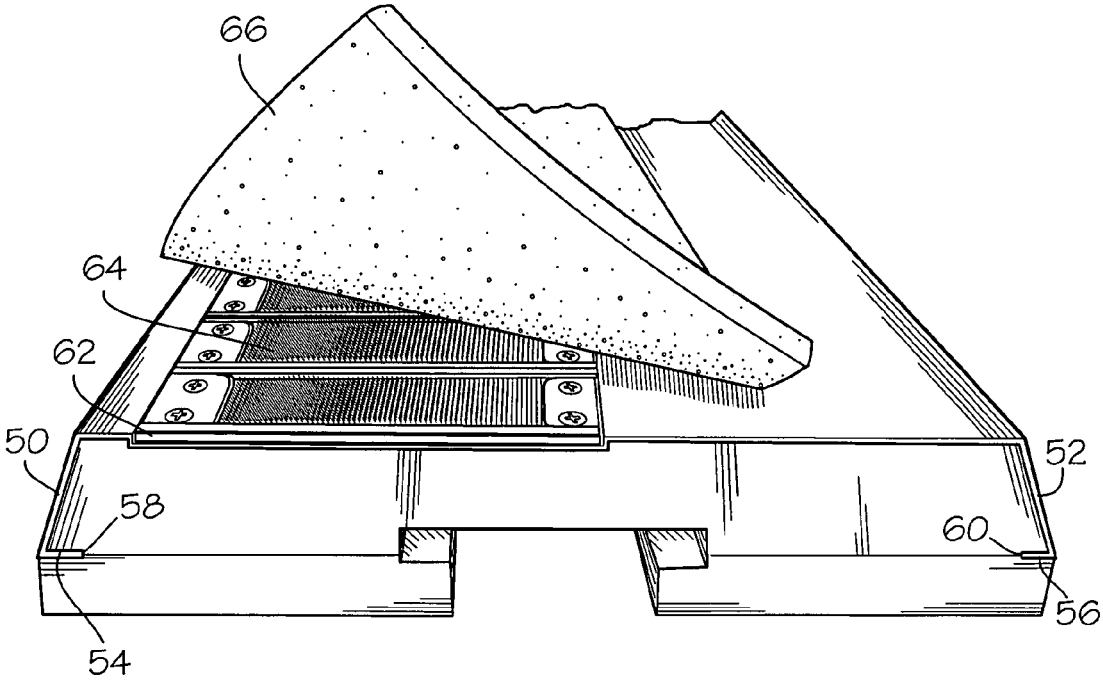
FIG. 5 is a perspective view of another preferred embodiment of a tensioning board device according to the present invention.

Referring now to FIG. 5, a tensioning board may have a top surface cover 48 with a recessed portion that fits in the groove in the top surface of the board with the recessed portion becoming the groove of the board. Each side edge portion of cover 48 is a J-channel 50, 52 with flanges 54, 56 that fit into longitudinal grooves 58, 60 in the side edges of the board. Where longitudinal grooves 58, 60 are sufficiently deep, channel cover 48 may be secured to the board with flanges 54, 56 alone without screws or glue. Trays 62 may be attached to channel cover 48 by welding or the like so that cover 48 can be removed with removing the board which is much heavier. Hook pads 64 are attached to trays 62 with screws. Felt pad 66 is laid over the hook pads.

It can now be appreciated that an apparatus for tensioning strips of metal as the metal strips are rewound has been described. The apparatus includes a board defining a groove in its top surface. A tray has opposed side portions and opposed end portions and is disposed in the groove. Each of the side portions of the tray has an upturned flange. A hook pad having a plurality of upwardly extending hooks is disposed in the tray between the flanges. The hook pad and tray are removably fastened the to the board. A felt pad attaches to the hook pad to grab and hold the metal strips that are being rewound to provide tension for uniform winding.

In an alternative embodiment, the apparatus includes a board having a top surface defining a groove and a bottom surface. A cover having a recessed portion is disposed on the top surface with the recessed portion disposed in the groove. Means are provided for removably attaching the cover to the board. A tray having opposed side portions and opposed end portions is disposed in the recessed portion. Each of the side portions has an upturned flange. A hook pad disposed in the tray between the flanges and has a plurality of upwardly extending hooks for grabbing and holding a felt pad. Means are provided for removably fastening the hook pad and tray to the cover.

While the invention has been described with particular reference to the preferred embodiments, it will be understood by those skilled in the art that various changes may be made and equivalents may be substituted for elements of the preferred embodiments without departing from invention. For example, while the tensioning board has been described as constructed of wood, other materials, even metal, could be used. Also, the jacks may be hydraulic or pneumatic, and electrical solenoids can be used as well. In addition, the boards do not have to be parallel to one another; a scissor arrangement can be used. It is accordingly intended that the claims shall cover all such modifications and applications as do not depart from the true spirit and scope of the invention.

| Element List | |
|---|---|
| 10 | wound roll |
| 12 | slitter |
| 14 | roller |
| 16 | roller |
| 18 | tensioning mechanism |
| 20 | mandrel |
| 22 | upper jack |
| 24 | lower jack |
| 26 | upper board |
| 28 | lower board |
| 30 | top surface groove |
| 32 | bottom locking groove |
| 34 | tray |

-continued

| Element List | |
|---|---|
| 36 | screw holes |
| 38 | screws |
| 40 | end clip |
| 42 | hook pad |
| 44 | hooks |
| 46 | felt pad |
| 48 | top surface cover |
| 50 | left J-channel |
| 52 | right J-channel |
| 54 | left flange |
| 56 | right flange |
| 58 | left longitudinal groove |
| 60 | right longitudinal groove |
| 62 | tray |
| 64 | hook pad |
| 66 | felt pad |

What is claimed is:

1. An apparatus for tensioning strips of metal as the metal strips are rewound, comprising:

a board having a top surface defining a groove and a bottom surface;

a tray having opposed side portions and opposed end portions and disposed in said groove, each of said side portions having an upturned flange;

a hook pad disposed in said tray between said flanges and having a plurality of upwardly extending hooks; and means for removably fastening said hook pad and tray to said board.

2. An apparatus, as set forth in claim 1, wherein said flanges limit upward movement of said hook pad.

3. An apparatus, as set forth in claim 1, wherein said means for removably fastening said hook pad and tray to said board includes an end clip for each end portion of said tray, said clips, hook pad and tray having openings that align to receive a screw for fastening said clips, hook pad and tray to said board.

4. An apparatus, as set forth in claim 1, wherein said bottom surface of said board define a bottom groove.

5. An apparatus for tensioning strips of metal as the metal strips are rewound, comprising:

a board having a top surface defining a groove and a bottom surface;

a cover having a recessed portion and being disposed on said top surface with said recessed portion disposed in said groove;

means for removably attaching said cover to said board;

a tray having opposed side portions and opposed end portions and disposed in said recessed portion, each of said side portions having an upturned flange;

a hook pad disposed in said tray between said flanges and having a plurality of upwardly extending hooks; and means for removably fastening said hook pad and tray to said cover.

6. An apparatus, as set forth in claim 5, wherein said flanges limit upward movement of said hook pad.

7. An apparatus, as set forth in claim 5, wherein said means for removably fastening said hook pad and tray to said cover includes an end clip for each end portion of said tray, said clips, hook pad and tray having openings that align to receive a screw for fastening said clips, hook pad and tray to said cover.

8. An apparatus, as set forth in claim 5, wherein said bottom surface of said board define a bottom groove.

9. An apparatus, as set forth in claim 5, wherein said means for removably attaching said cover to said board includes flanges on said cover and side grooves in said board for receiving said flanges.

* * * * *